US008535092B2

(12) United States Patent
Holliday

(10) Patent No.: US 8,535,092 B2
(45) **Date of Patent: *Sep. 17, 2013**

(54) MINI-COAX CABLE CONNECTOR

(75) Inventor: Randall A. Holliday, Broomfield, CO (US)

(73) Assignee: Belden Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/400,282

(22) Filed: Feb. 20, 2012

(65) Prior Publication Data

US 2012/0270442 A1 Oct. 25, 2012

Related U.S. Application Data

(63) Continuation of application No. 12/685,606, filed on Jan. 11, 2010, now Pat. No. 8,142,223, which is a continuation-in-part of application No. 11/895,367, filed on Aug. 24, 2007, now Pat. No. 7,645,161, which is a continuation-in-part of application No. 11/716,488, filed on Mar. 9, 2007, which is a continuation-in-part of application No. 10/927,884, filed on Aug. 27, 2004, now Pat. No. 7,188,507.

(51) Int. Cl.
*H01R 9/05* (2006.01)

(52) U.S. Cl.
USPC ..... 439/578

(58) Field of Classification Search
USPC ..... 439/578
See application file for complete search history.

(56) References Cited

U.S. PATENT DOCUMENTS

| | | | | |
|---|---|---|---|---|
| 2,369,180 | A | 2/1945 | Rosenthal | |
| 3,126,750 | A | 3/1964 | Willis | |
| 3,296,363 | A | 1/1967 | Laudig et al. | |
| 4,668,043 | A | 5/1987 | Saba et al. | |
| 4,684,201 | A | 8/1987 | Hutter | |
| 4,685,201 | A | 8/1987 | Boyd, Jr. | |
| 4,902,246 | A | 2/1990 | Samchisen | |
| 4,932,091 | A | 6/1990 | Krzyzanski | |
| 5,024,606 | A | 6/1991 | Ming-Hwa | |
| 5,073,129 | A | 12/1991 | Szegda | |
| 5,105,648 | A | 4/1992 | Steiner et al. | |
| 5,127,853 | A | 7/1992 | McMills et al. | |
| 5,269,701 | A | 12/1993 | Leibfried, Jr. | |
| 5,392,508 | A * | 2/1995 | Holliday et al. | 29/751 |

(Continued)

OTHER PUBLICATIONS

Office Action for U.S. Appl. No. 11/716,488, mail date Jan. 13, 2010, 7 pages.

(Continued)

*Primary Examiner* — Truc Nguyen
(74) *Attorney, Agent, or Firm* — Schmeiser, Olsen & Watts LLP

(57) ABSTRACT

A connector of termination assembly for a mini-coaxial cable in different embodiments is made up of an extension tip which is preassembled in a connector body to receive the inner conductor pin on the cable, a first inner sleeve which fits over an exposed end of the dielectric layer, a second outer sleeve which surrounds a compression ring, and a crimping ring is mounted on the outside of the outer sleeve to force the sleeves to be radially contracted into crimping engagement with the cable. Variations of the connector body may be employed for different types of connectors including modifications in the extension tip to facilitate insertion of the conductor into the assembly and color bands to signify the size of cable and intended application.

14 Claims, 11 Drawing Sheets

(56) References Cited

U.S. PATENT DOCUMENTS

| | | | | |
|---|---|---|---|---|
| 5,469,613 | A | 11/1995 | McMills et al. | |
| 5,470,257 | A | 11/1995 | Szegda | |
| 5,479,613 | A | 12/1995 | Geyer et al. | |
| 5,501,616 | A | 3/1996 | Holliday | |
| 5,529,513 | A * | 6/1996 | Lee | 439/491 |
| 5,546,653 | A | 8/1996 | Tournier et al. | |
| 5,586,910 | A | 12/1996 | Del Negro et al. | |
| 5,595,499 | A * | 1/1997 | Zander et al. | 439/352 |
| 5,651,699 | A | 7/1997 | Holliday | |
| 5,667,405 | A | 9/1997 | Holliday | |
| 5,845,393 | A | 12/1998 | DePaiva | |
| 5,863,220 | A | 1/1999 | Holliday | |
| 5,934,137 | A | 8/1999 | Tarpill | |
| 5,975,949 | A | 11/1999 | Holliday et al. | |
| 5,997,350 | A | 12/1999 | Burris et al. | |
| 6,089,913 | A | 7/2000 | Holliday | |
| 6,112,404 | A | 9/2000 | Tarpill | |
| 6,146,197 | A | 11/2000 | Holliday et al. | |
| 6,153,830 | A | 11/2000 | Montena | |
| 6,293,004 | B1 * | 9/2001 | Holliday | 29/751 |
| 6,352,448 | B1 * | 3/2002 | Holliday et al. | 439/585 |
| 6,594,888 | B2 | 7/2003 | Chang | |
| 6,708,396 | B2 | 3/2004 | Holliday | |
| 6,783,394 | B1 | 8/2004 | Holliday | |
| 6,805,583 | B2 * | 10/2004 | Holliday et al. | 439/578 |
| 6,830,479 | B2 | 12/2004 | Holliday | |
| 6,848,940 | B2 | 2/2005 | Montena | |
| 6,916,200 | B2 | 7/2005 | Burris et al. | |
| 6,935,892 | B2 | 8/2005 | Holliday | |
| 6,948,234 | B1 * | 9/2005 | Steiner | 29/751 |
| 7,044,771 | B2 * | 5/2006 | Holliday | 439/491 |
| 7,156,695 | B2 | 1/2007 | Holliday | |
| 7,179,122 | B2 | 2/2007 | Holliday | |
| 7,182,628 | B2 | 2/2007 | Holliday | |
| 7,188,507 | B2 | 3/2007 | Holliday et al. | |
| 7,326,079 | B2 | 2/2008 | Holliday et al. | |
| 7,367,832 | B2 | 5/2008 | Muhs et al. | |
| 7,410,389 | B2 | 8/2008 | Holliday | |
| 7,645,161 | B2 | 1/2010 | Holliday | |
| 7,727,015 | B2 | 6/2010 | Holliday | |
| 8,075,339 | B2 | 12/2011 | Holliday | |
| 2005/0148236 | A1 | 7/2005 | Montena | |
| 2006/0042346 | A1 | 3/2006 | Holliday et al. | |

OTHER PUBLICATIONS

Office Action for U.S. Appl. No. 11/716,488, mail date Jun. 9, 2010, 12 pages.

* cited by examiner

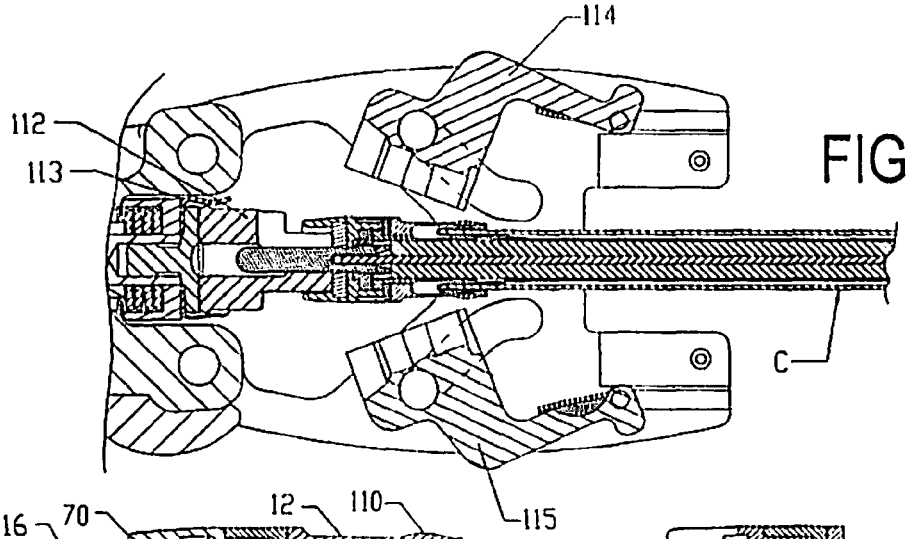
FIG. 14
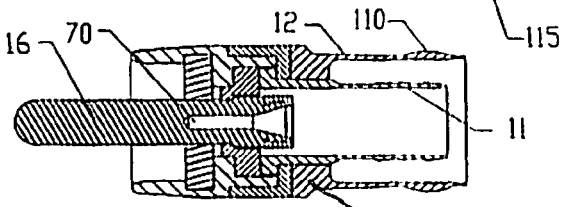
FIG. 15 10'
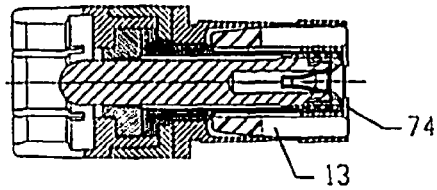
FIG. 16

MINI-COAX CABLE CONNECTOR

CROSS-REFERENCE TO RELATED APPLICATIONS

This application is a continuation of U.S. application Ser. No. 12/685,606, filed Jan. 11, 2010, which is a continuation-in-part of U.S. application Ser. No. 11/895,367, filed Aug. 24, 2007, now U.S. Pat. No. 7,645,161, which is a continuation-in-part of U.S. application Ser. No. 11/716,488, filed Mar. 9, 2007, which is a continuation-in-part of U.S. application Ser. No. 10/927,884, filed Aug. 27, 2004, now U.S. Pat. No. 7,188,507. All of these applications are incorporated by reference herein in their entireties.

BACKGROUND

The following relates to coaxial cable connectors and more particularly relates to a novel and improved mini-coaxial cable connector assembly which is conformable for use with different size cables in effecting positive engagement with a connector assembly in connecting the cable to a post or terminal.

The problems associated with the connection of mini-coaxial cables as well as larger size cables to a post or terminal in the field are discussed at some length in hereinabove referred to co-pending application for patent for MINI-COAXIAL CABLE CONNECTOR and in U.S. Pat. No. 6,352,448 for CABLE TV END CONNECTOR STARTER GUIDE. This invention is directed to further improvements in termination assemblies to be employed for mini-coaxial cables in which the termination assembly is characterized in particular by being comprised of a minimum number of pre-assembled parts which can be quickly assembled at the manufacturing site as well as in the field and is readily conformable for connection of different sized mini-coaxial cables to BNC and RCA connectors. Further wherein an extension tip can be recessed to permit a conductor to be positioned toward the back of the connector assembly, such as, for example, RCA connector assemblies; and including a novel form of centering guide for guiding the conductor into the recessed end of the extension tip.

SUMMARY

In one aspect it is desirable to eliminate any form of a coupling or adaptor sleeve for small diameter coaxial cables so that the cable can be installed directly into the end of an extension tip which has been preassembled within the connector body.

In another aspect the connector body is provided with the necessary adaptability for connection to different sized cables and in such a way as to assure accurate alignment between the cable and connector preliminary to crimping of the connector onto the cable and prevents shorting between the cable layers with one another as well as with conductive portions of the connector; and specifically wherein inner and outer concentric compression members in the crimping region of the connector body cooperate in effecting positive engagement with the cable.

The foregoing is achieved by direct connection of the exposed end of a coaxial cable to an extension tip either prior to or after mounting of the extension tip in a hollow connector body wherein the cable is of the type having inner and outer concentric electrical conductors, an annular dielectric separating the conductors and an outer jacket of electrically non-conductive material, the inner and outer conductors being exposed at the end and the inner conductor projecting beyond the dielectric at one end of the cable; and the connector body is characterized by having a slotted compression ring which cooperates with an inner slotted sleeve to effect positive engagement with the cable in response to radially inward compression. The inner sleeve and compression ring are dimensioned to undergo the necessary compression in response to axial advancement of a crimping ring, and the trailing end of the inner sleeve is slotted to form prong-like segments having internal and external teeth so that the trailing end of the sleeve can be compressed into engagement with the cable without crushing the dielectric layer.

A spring-like retainer clip within a bore at one end of the extension tip is adapted to grasp the conductor pin and connect to the tip, and the retainer clip can be varied in size for different diameter conductor pins. Elimination of the adaptor sleeve on the cable affords greater latitude in visualization of the color of the extension tip as well as the compression ring; and either or both may be color-coded to match up with different sized cables.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

The above and other objects, advantages and features of the present invention will become more readily appreciated and understood from a consideration of the following detailed description of preferred and modified forms of the present invention when taken together with the accompanying drawings in which:

BRIEF DESCRIPTION OF THE DRAWINGS

FIG. 14 is a somewhat fragmentary, longitudinal sectional view of a compression tool utilized in combination with another embodiment of a connector assembly;

FIG. 15 is a sectional view in more detail of the connector assembly shown in FIG. 14;

FIG. 16 is a sectional view of the end of another form of connector assembly utilized with mini-coaxial cable connectors;

DETAILED DESCRIPTION OF ONE EMBODIMENT

Figure 1:
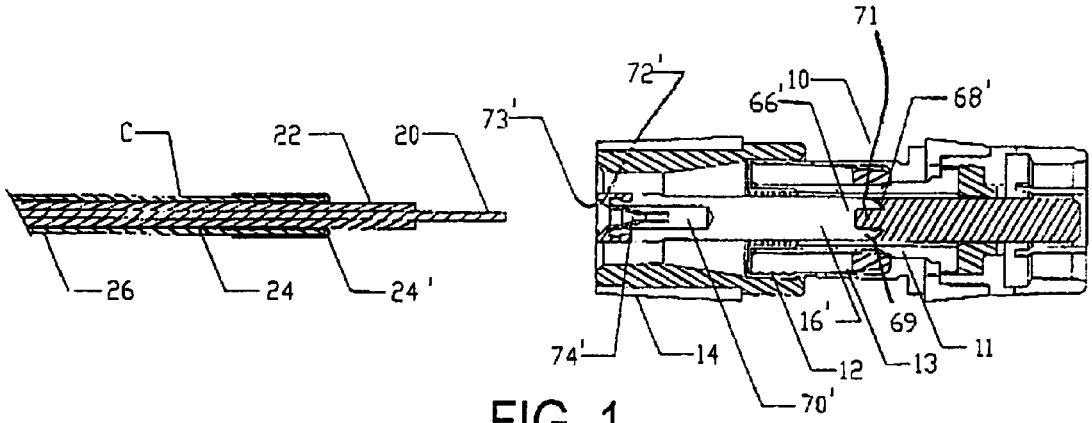
FIG. 1 is an exploded, longitudinal sectional view of one embodiment comprised of the standard mini-coaxial cable prior to insertion into a connector assembly having a modified pre-assembled extension tip.

Referring in more detail to the drawings, there is illustrated in FIGS. 1 to 8 one embodiment which is comprised of a standard mini-coaxial cable C, a hollow connector body 10 having inner and outer concentric sleeves 11 and 12, and a plastic compression ring 13. A crimping ring assembly 14 is preassembled at one end of the body 10, and a modified extension tip 16' is preassembled at the opposite end of the body 10 to the crimping ring assembly 14.

As a setting for the embodiments to be described, the cable C is made up of an inner conductor pin or wire 20 which is surrounded by a dielectric insulator 22 of electrically non-conductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the jacket 26 and braided conductor 24 as well as the insulated layer 22 in order to expose an end of the pin 20 along with a foil layer surrounding the pin 20. The braided conductor layer 24 is peeled away from the insulator 22 and doubled over as at 24' to cover the leading end of the jacket 26.

As shown in FIGS. 1 to 8, the sleeve 11 has a thin-walled, annular trailing end 28 and sealing rings or ribs 29 along its inner surface in facing relation to the jacket 26, and the body 10 terminates in an annular shoulder 30 at one end having an annular end flange 32 in abutting relation to an insulator guide 33. The sleeve 11 is dimensioned such that the trailing end 28 will extend over the end of the doubled-over layer 24' when the pin 20 is inserted into the end of the extension tip 16 in a manner to be described in more detail. For this purpose, the layer 22 is exposed for a length corresponding to the length of the wall portion 28 of the sleeve 11 when assembled in the relationship shown in FIG. 4. The outer sleeve 12 has a thin-walled trailing end 34 aligned in outer spaced concentric relation to the end 28 to form an annular space therebetween for insertion of the compression ring 13, and the trailing end 34 is raised slightly from the outer surface of the sleeve 12 to form a shoulder 27 at one end to receive the offset end 15 of the crimping ring 14. The inner surface of the trailing end 34 is provided with a series of sealing ribs or rings 35 to engage the outer surface of the compression ring 13. The sleeve 12 terminates at its opposite end in a thickened annular end portion 40, including a radially inner wall surface flush with the external wall surface of the end flange 32, and a radially outwardly extending shoulder 39 is interposed between one end of the crimping ring assembly 14 and a reinforcing band 42 on the outside of the connector body 10.

Figure 8:
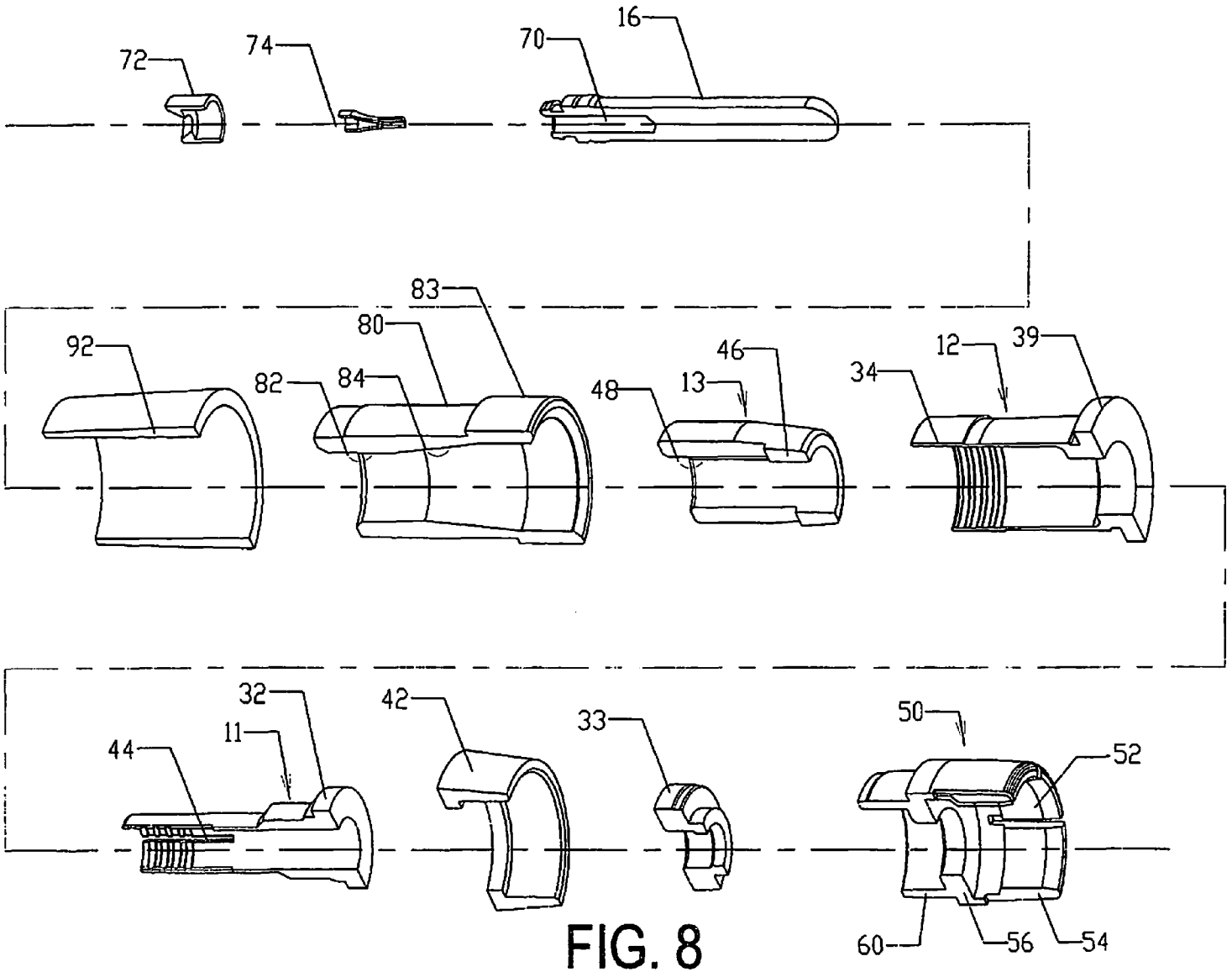
FIG. 8 is an exploded view of the parts comprising the modified extension tip and connector body prior to assembly.

As best seen from the exploded view of FIG. 8, the trailing end 28 of the inner sleeve 11 is provided with circumferentially spaced longitudinal slots 44 of a length substantially corresponding to the slotted end of the compression ring 13 to be described, the slots each being of a width to control the inward degree of bending by the crimping ring assembly 14. Similarly, the compression ring 13 has a solid or continuous annular end 46 and circumferentially spaced longitudinal slots 48 extending from the end 46 for the greater length of the ring 13 toward its trailing end and dividing the ring 13 into a series of elongated annular segments, the slots 48 each being of a width to control the degree of inward bending when compressed by the crimping assembly 14. Further, the compression ring 13 is composed of a plastic material of limited flexibility and dimensioned to be of a thickness to assure positive engagement of the inner sleeve 11 with the cable C when the extension tip 16' is inserted into the body 10. Again, it is important to dimension the width of the slots 48 to limit the amount of contraction of the ring 13 so that the sealing ribs 29 will compress the jacket 26 enough to prevent pull-out but not enough to crush the dielectric layer 22. This is especially important in cables operating at higher frequencies in which any bending or crushing of the dielectric can create an impedance that downgrades the signal and prevents return losses. As further seen from FIG. 3, the prepared cable C is inserted into the tip 16' and advanced through the body 10 until the slotted segments of the inner sleeve 11 are positioned over the doubled-over layer 24' and jacket 26.

Figure 3:
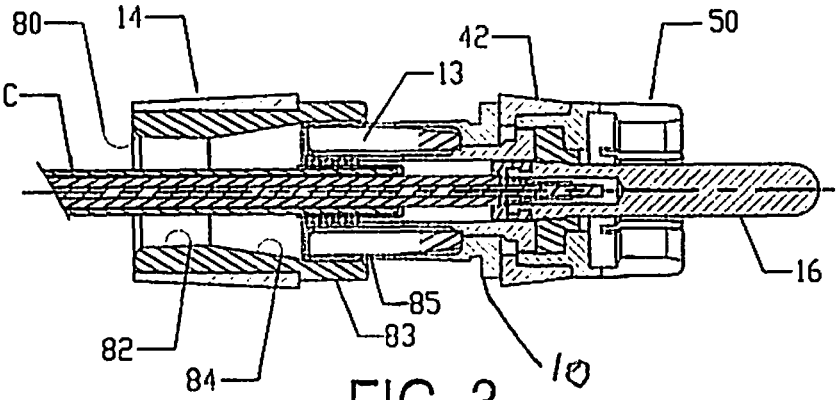
FIG. 3 is another longitudinal sectional view of the one embodiment illustrating advancement of the extension tip and cable through the connector assembly prior to the crimping operation.

The opposite end of the body 10 is made up of a ferrule 50 which is slotted as at 52 into spring-like annular segments 54 extending from an annular base portion 56 of the ferrule 50 to facilitate attachment to a post or terminal, not shown, and the base 56 forms a central opening or passage for advancement of the tip 16 beyond the end of the ferrule, as shown in FIG. 3. The base 56 has a rearward extension or keeper 60 of annular configuration between the band 42 and the guide 33 as well as the flange 39 on the inner sleeve. Thus, the inner walls of the sleeve 11 and guide 33 define the inner wall surface of the body 10, and the guide 33 is provided with an internal shoulder 63 to limit advancement of the extension tip 16 through the body 10.

Figure 2:
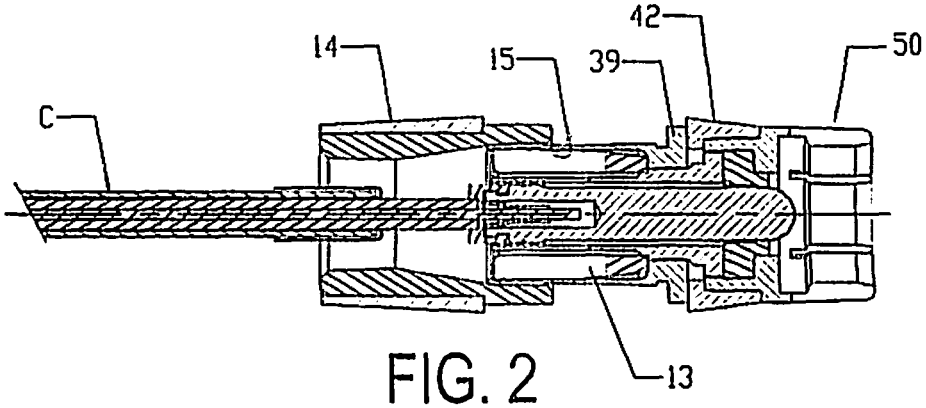
FIG. 2 is a longitudinal sectional view of the one embodiment of FIG. 1 with the mini-coaxial cable inserted into the modified extension tip prior to a crimping operation.

The modified extension tip 16' and cable C are illustrated in exploded form in FIG. 1, the tip 16' being shown inserted into the connector body 10 and comprises an elongated cylindrical metal body 66' terminating in a recessed end 68' for press-fit engagement with a supplementary plastic extension rod 69; and an elongated central bore or recess 70' extends through the opposite end for a limited length of the tip 16'. The extension rod 69 is of a diameter corresponding to the tip 16' with a projecting end 71 of reduced diameter for press-fit engagement with the recessed end 68'. When the extension rod is inserted into the connector body and advanced through the centering guide 33 as shown in FIGS. 1-3, the extension tip 16' will project to a position close to or flush with the end of the crimping ring assembly 14. An annular insulator cap 72' is mounted on the opposite end of the tip 16' in surrounding relation to the entrance to the bore 70 and supports the end of an elongated spring 74' extending through the bore and offset from the wall slightly to bear against the conductor pin 20. The end of the cap 72' is beveled as at 73' to wedge against the dielectric layer 22 surrounding the pin 20 and which is peeled away from the pin 20 into the outer layer 24' as earlier described.

Figure 4:
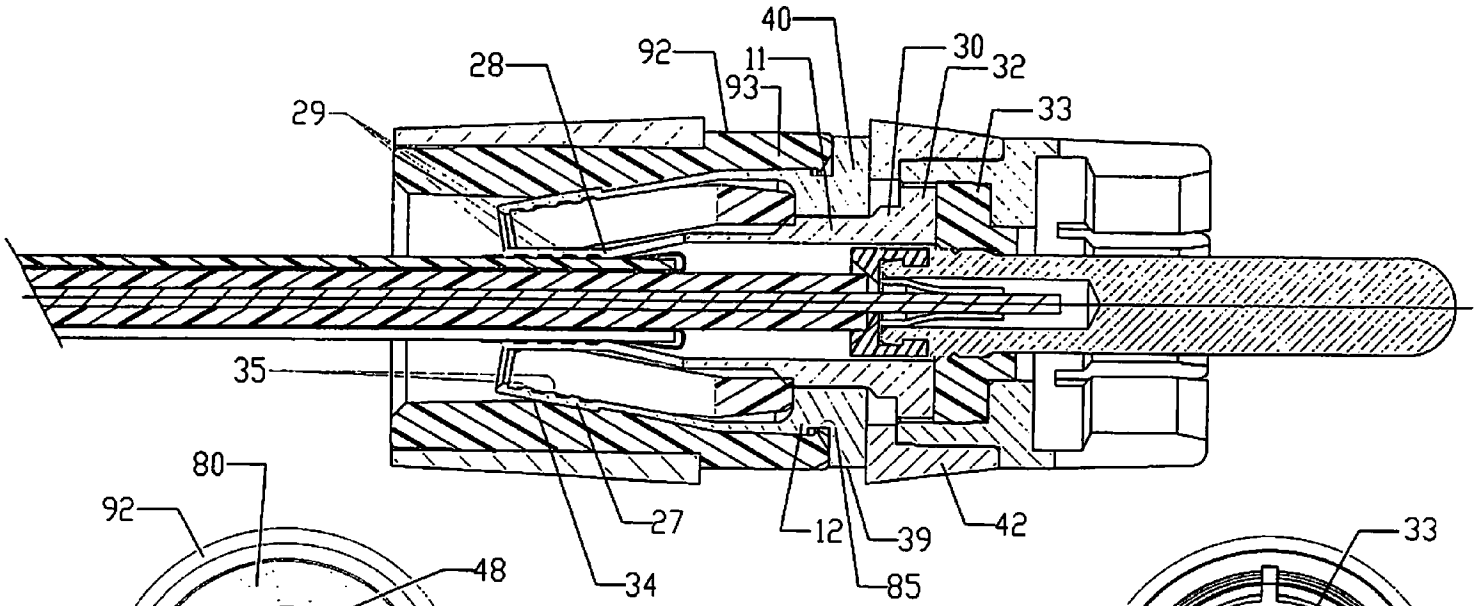
FIG. 4 is an enlarged longitudinal sectional view of the one embodiment following the crimping operation.
Figure 6:
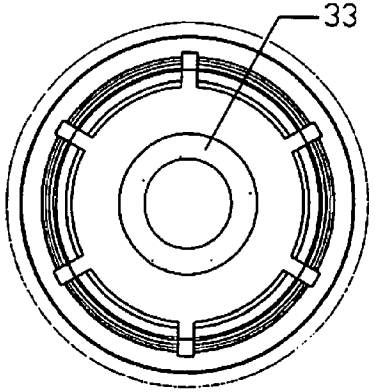
FIG. 6 is an end view of the opposite end of the one embodiment to that shown in FIG. 5.
Figure 5:
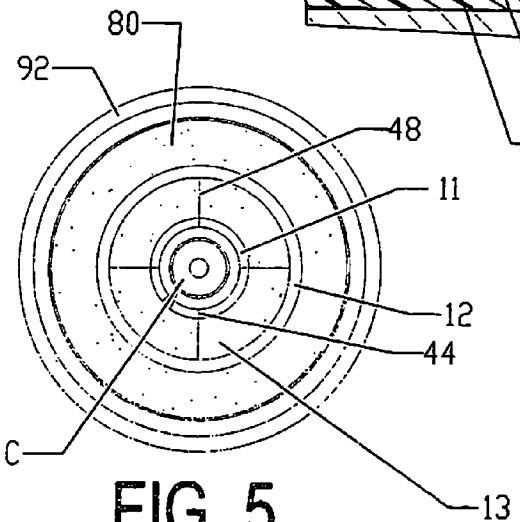
FIG. 5 is an end view of the one embodiment illustrated from the entrance end of the cable.
Figure 7:
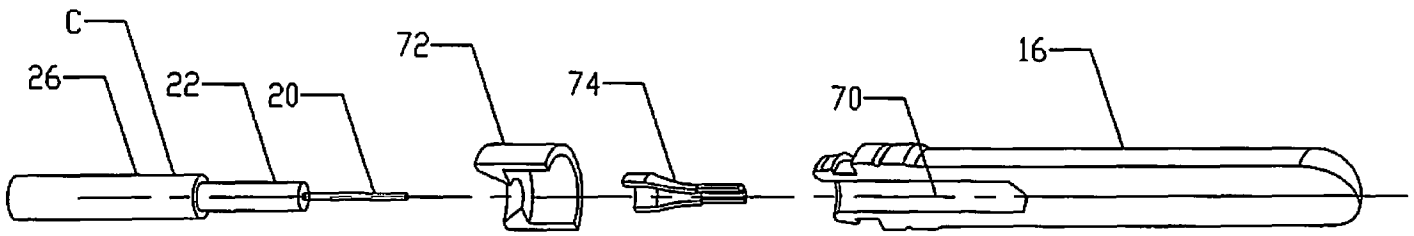
FIG. 7 is an exploded view of the parts comprising the coaxial cable and modified extension tip prior to assembly.

The crimping ring assembly 14 is of a type that can be preassembled onto the connector body 10 and axially advanced over the sleeve 12 to force it into crimping engagement with the slotted end 44 of the compression ring 13. To this end, the crimping ring 14 is made up of an annular body 80 composed of a low-friction material having limited compressibility, such as, DELRIN.RTM. or other hardened plastic material. The body has a straight cylindrical portion 82 and a forwardly tapered portion 84 which terminates in a leading end 83 having an internal shoulder or rib 85. The leading end 83 fits over the trailing end of the sleeve 12 so that the crimping ring 14 can be axially advanced over the end of the sleeve 12 until the internal shoulder or rib 85 advances past the raised end 34, as shown in FIG. 4, to preassemble the ring 14 onto the connector 10.

An exterior surface of the body 80 is recessed or undercut to receive a reinforcing liner 92 which is preferably composed of brass and which fits snugly over the body 80. The leading end 93 of the liner 92 projects outwardly beyond the external surface of the body 80 to define an external shoulder of a diameter slightly greater than that of the leading end 83, as best seen from FIG. 4.

The extension tip 16' is inserted into the connector body 10 until the end of the extension rod 69 opposite to the reduced end 79 is positioned in alignment with the centering guide 33, as shown in FIG. 1, so that the entrance to the bore 70' is at or in close proximity to the entrance to the crimping ring assembly 14 to thereby facilitate insertion of the conductor pin 20 into the beveled end 73' of the bore 70'. The crimping ring assembly 14 is preassembled onto the sleeve 12, as described earlier. Typically, the extension tip 16' and crimping ring 14 are preassembled in the manner just described prior to shipment to the field so that the color coding of the elements is followed to signify the desired cable size and application of the connector assembly to the installer. Although not illustrated in FIGS. 2 and 3, when the cable is advanced to the intermediate position shown in FIG. 2, the extension rod 69 can be removed or permitted to drop off the end of the extension tip 16'. A standard crimping tool, not shown, may be employed to axially advance the crimping ring 14 over the sleeve 12 until the leading end or rib 85 moves into snap-fit engagement with the groove 41 and abuts the shoulder 40. The tapered surface 84 will cause the end portion 34 of the sleeve 12 to radially contract and force the compression ring 13 into positive engagement with the inner sleeve 11 and in turn cause the rings 29 on the segments to be crimped into positive engagement with the jacket 26 as well as the doubled-over portion 24'. One such crimping tool is disclosed in U.S. Pat. No. 6,089,913 and is incorporated by reference herein. The cooperation between the ribs 34 when forced into the compression ring 13 and in turn forcing the internal teeth 29 into engagement with the layer 24' as well as the jacket 26 increases the pull-out strength of the termination assembly both with respect to the end of the cable C and the connector 10.

Detailed Description of a Second Embodiment with Crimping Ring Assembly

Figure 9:
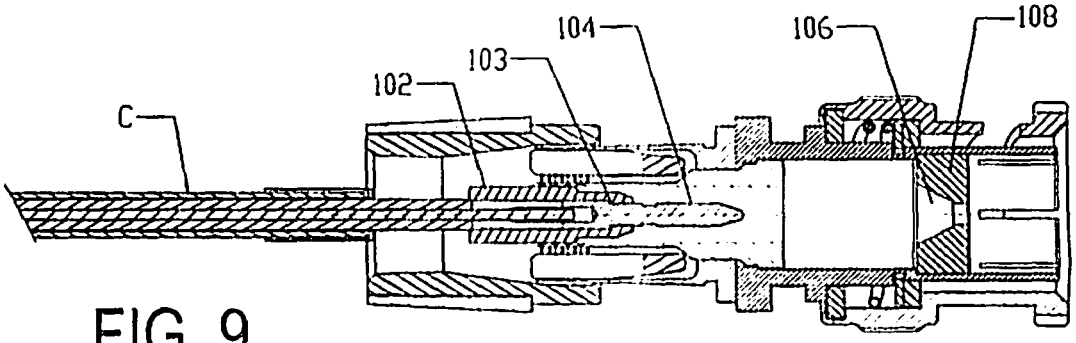
FIG. 9 is a longitudinal sectional view of a second embodiment illustrating a BNC connector assembly and illustrating a mini-coaxial cable inserted into the pre-assembled modified extension tip.
Figure 10:
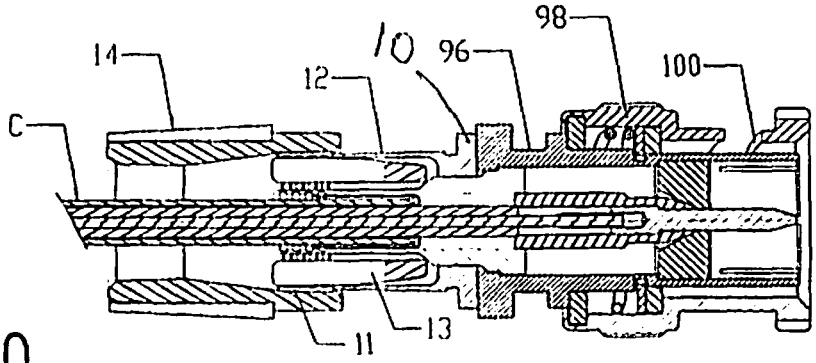
FIG. 10 is another longitudinal sectional view of the embodiment shown in FIG. 9 after advancement of the cable and extension tip through the connector assembly but prior to the crimping operation.
Figure 11:
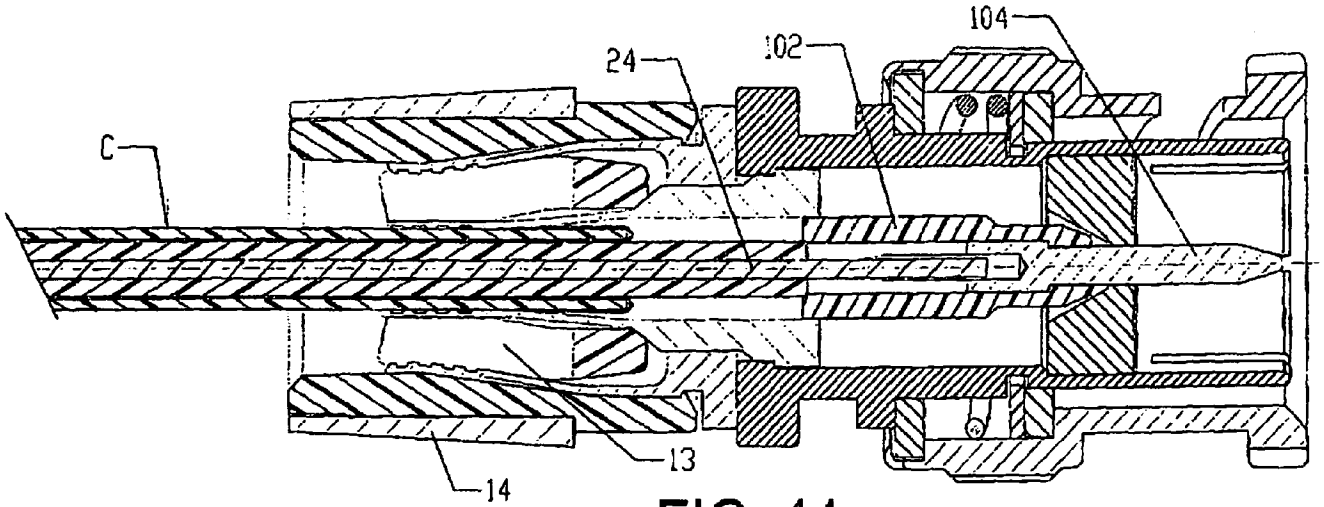
FIG. 11 is an enlarged longitudinal sectional view of the second embodiment shown in FIGS. 9 and 10 following the crimping operation.
Figure 13:
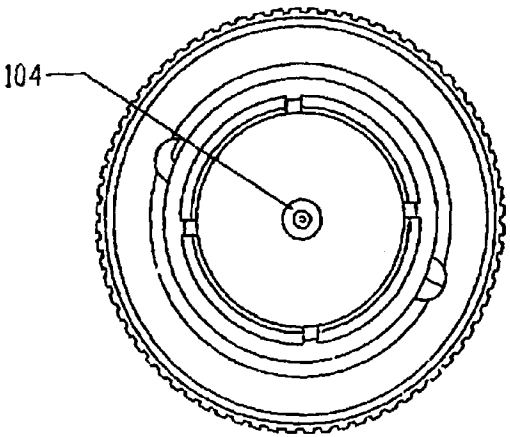
FIG. 13 is an end view taken from the opposite end of FIG. 11 to that of FIG. 12.
Figure 12:
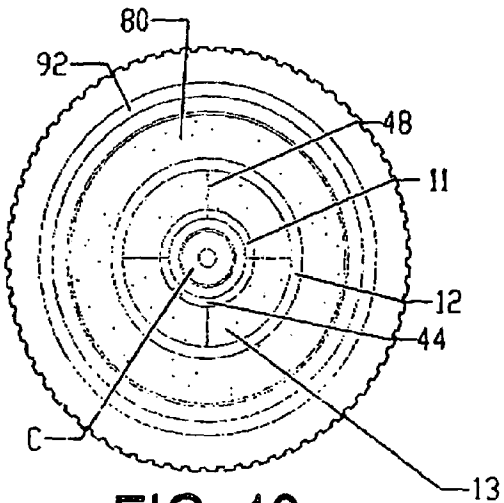
FIG. 12 is an end view taken from the entrance end of the cable in FIG. 11.

FIGS. 9 to 13 illustrate a modified form of connector assembly 10' for a BNC connector or fitting of increased length compared to the RCA connector shown in FIGS. 1 to 8 and having an elongated barrel 96 with a bayonet slot 98 connected to a ferrule 100 Inner and outer spaced connector sleeves 11 and 12 and compression ring 13 along with the crimping ring assembly correspond to those of FIGS. 1 to 8 and are correspondingly enumerated along with the cable C. Owing to the increased length of the fitting, the extension tip 16 is replaced by an insert socket 102 having a hollow nose 103 of reduced diameter which is slidably disposed within the inner sleeve 11, and an extension pin 104 is disposed on the exposed end of the conductor pin 22 of the cable C. Initially, as shown in FIG. 9, the pin 104 will guide the cable C into engagement with the socket 102. Continued advancement of the cable C will cause the pin 104 to carry the socket 102 into alignment with a beveled opening 106 in a stationary block 108 at the end of the ferrule 100 and until the pin 104 reaches the end of the ferrule 100, as shown in FIG. 10. In a manner corresponding to FIGS. 1 to 8, forward advancement of the crimping ring assembly 14 will crimp the inner sleeve 11 into positive engagement with the cable jacket 26, as illustrated in FIGS. 11 to 13; and as best illustrated in the end view of FIG. 12, the compression ring 13 can be dyed a specific color representing the size of cable C which will best fit and provide optimum crimping engagement with the connector body 10.

Detailed Description of First and Second Embodiments with Compression Tool

Figure 17:
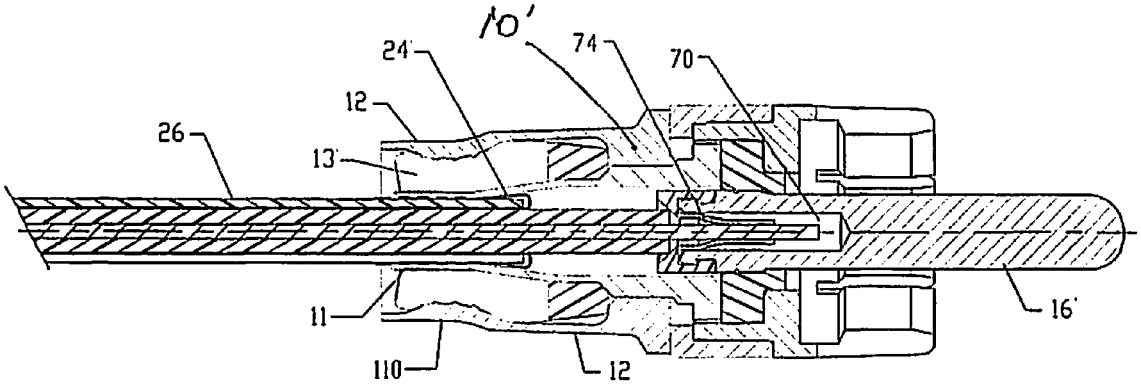
FIG. 17 is a longitudinal sectional view of the embodiment shown in FIGS. 14 and 15 after the crimping operation.

FIG. 14 illustrates a compression tool T in place of a crimping ring assembly 14 previously described for crimping an RCA connector similar to that of FIGS. 1 to 8 and in which like parts of the cable C and connector body 10 are correspondingly enumerated. The principal modification is the utilization of an outer sleeve 12' having a convex raised surface portion 110. The cable C is inserted into the tip extender 16 so as to be anchored in chuck 112 and centered in relation to the dies 114, 115 as the dies 114, 115 are advanced into crimping engagement with the outer sleeve 12'. Again, and as shown in FIGS. 15 and 16, the connector body 10' includes an annular plastic insert 13' in the space between the inner and outer concentric sleeves 11' and 12' for the mini-coaxial cable represented at C, and the outer jacket 26 and braided insulator 24 are positively engaged by the inner sleeve 11' when the outer sleeve 12' and ring 13' are compressed radially inwardly by the compression tool T, as shown in FIG. 17.

Figure 18:
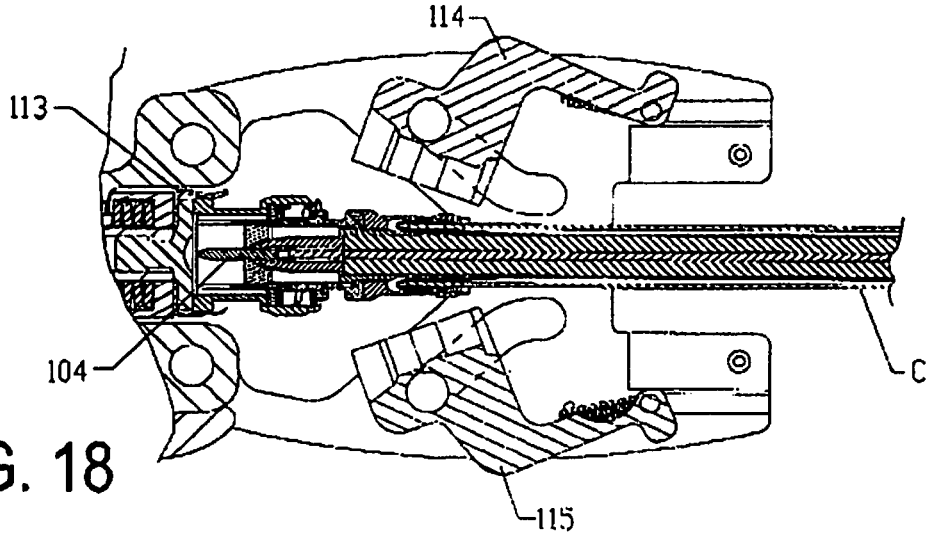
FIG. 18 is a longitudinal sectional view of still another embodiment with the parts assembled prior to advancement through the connector assembly.
Figure 19:
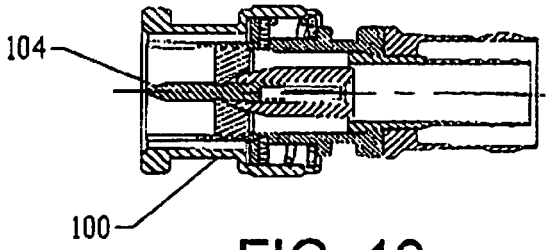
FIG. 19 is another sectional view corresponding to that of FIG. 18 with the coaxial cable and extension tip fully inserted into the connector assembly.
Figure 20:
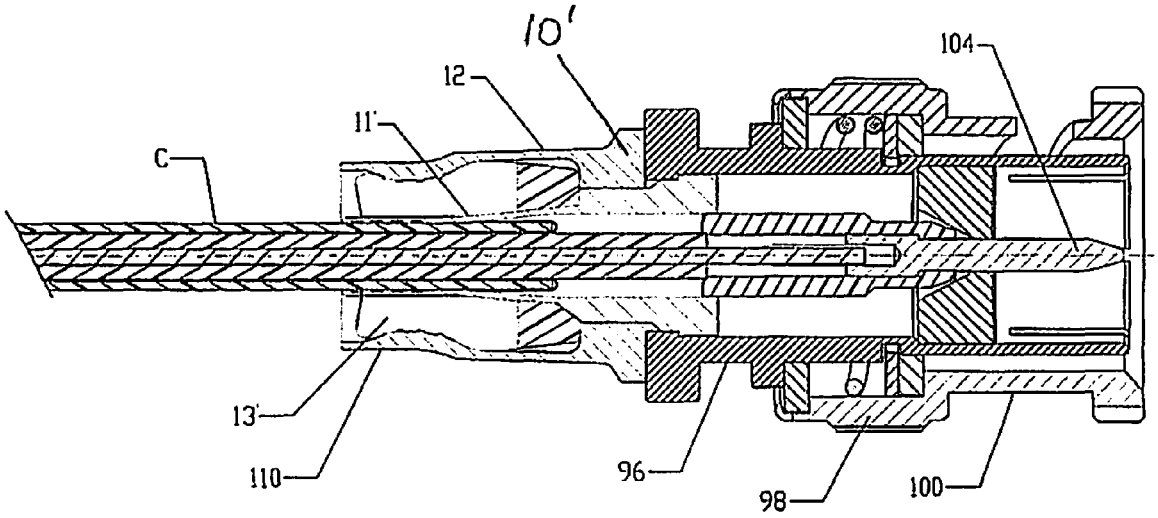
FIG. 20 is a longitudinal sectional view of the embodiment shown in FIGS. 18 and 19 following the crimping operation;.

FIGS. 18 to 20 illustrate the manner in which the BNC connector of FIGS. 9 to 13 can be crimped by the compression tool T and specifically wherein the ferrule 100 is inserted between the spring clips 113 prior to compression of the sleeves 11', 12' and the compression ring 13' by the compression die members 114 and 115.

Mini-coaxial cables are particularly useful in cellular telephones, security cameras and other applications where there are decided space limitations or where short runs of cable are used. Referring to the embodiments shown and described, it will be evident that the thickness of the compression ring 13, as well as the width of the slots 44 and 48 may be varied according to the size or diameter of the cable C and be proportioned according to the space allowance between the cable C and the connector sleeve 11. Further, the compression ring may be installed either before or after shipment to the field. For example, it may be desirable for the installer to select a particular size of compression ring which would be dyed or colored to match a particular cable size. To that end, the compression ring 13 should have sufficient elasticity or spreadability to be inserted axially into the annular space between the assembled sleeves 11 and 12.

The resilient band 42 shown in FIG. 2, may be inserted into the groove formed between the ferrule 50 and the shoulder 40 after the connector has been crimped together into the closed position. The band 42 is manually stretchable over the end of the ferrule 50 and, when released, will contract into the groove as described. The band 42 also may be one of several different colors to signify the intended application of the connector to a particular use. In addition, the compression ring 13 as well as the guides 33 and 72 may be of different selected colors which represent the size of cable C for which the connector body 14 is designed. The cap is visible to the installer when inserting the cable C into the tip 16 prior to the crimping operation, and both the guide 33 and ring 13 are visible from either end of the connector body 10, as shown in FIGS. 5, 6 and 12, 13 after the crimping operation.

It is therefore to be understood that while different embodiments are herein set forth and described, the above and other modifications may be made therein without departing from the spirit and scope of the invention as defined by the appended claims and reasonable equivalents thereof.

What is claimed is:

1. A cable connector having a hollow cylindrical body provided with a fastening member extending from one end of said body for interchangeable connection to one of a plurality of electronic devices, each of said devices having a different application, a pair of inner and outer concentric sleeves at an opposite end of said body between which a compression ring is insertable, an extension tip insertable into said inner sleeve, and a coaxial cable having a conductor end insertable within a recessed end of said extension tip for electrical connection to a selected one of said devices, and a crimping member adapted to be advanced over said outer sleeve to compress said inner sleeve into crimping engagement with said cable.

2. In a cable connector according to claim 1 wherein said compression ring and said guide are visible from opposite ends of said body after said cable is mounted.

3. In a cable connector according to claim 1 wherein said cable is a mini-coaxial cable, and said extension tip is slidably mounted in said body.

4. In a cable connector according to claim 3 wherein said extension tip has a second recess at an end opposite to said first recessed end, and a centering guide mounted at an entrance end of said second recess.

5. In a cable connector according to claim 1 wherein said centering guide has a beveled end for guiding said conductor end into said recess.

6. In a cable connector according to claim 1 wherein said connector is conformable for connection of different sized cables, and said centering guide is of a selected color to signify the size of said cable insertable into said extension tip.

7. In a cable connector according to claim 1 wherein said body is an RCA connector body and said cable is a mini-coaxial cable.

8. In a cable connector according to claim 1 wherein said connector is a BNC connector and said cable is a mini-coaxial cable.

9. In a cable connector according to claim 1 wherein said extension tip is recessed at both ends and is slidable between a first position within said connector body and a second position at an end of said connector body for electrical connection with said device.

10. In a fitting for connecting a coaxial cable in centered relation to a hollow connector body wherein said cable includes an elongated conductor pin and wherein said connector body includes inner and outer sleeve members in spaced concentric relation to one another, the improvement comprising:

an extension tip inserted in a main bore of said connector body, said tip provided with a recess at one end for insertion of said conductor pin and an extension rod removably connected to an opposite end of said tip and wherein said tip and said rod are slidable through said connector body in response to axial movement of said cable and pin through said connector body;

a compression ring composed of a flexible plastic material being of a thickness to compensate for the spacing between said inner spaced concentric sleeve member and said cable; and means for crimping said sleeve members and said crimping ring whereby to force said inner sleeve into engagement with said cable.

11. In a fitting according to claim 10 wherein said extension tip is recessed at opposite ends and said rod is in press-fit engagement with said tip.

12. In a fitting according to claim 10 wherein said cable is a mini-coaxial cable.

13. In a fitting according to claim 10 wherein said body is an RCA connector body and said cable is a mini-coaxial cable.

14. In a fitting according to claim 10 wherein said connector is a BNC connector and said cable is a mini-coaxial cable.

* * * * *